US008986137B2

(12) United States Patent
Fitchett et al.

(10) Patent No.: US 8,986,137 B2
(45) **Date of Patent: *Mar. 24, 2015**

(54) BALL INCORPORATING ELEMENT FOR CRACKING COVER

(75) Inventors: Derek A. Fitchett, Portland, OR (US); Arthur P. Molinari, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 318 days.

This patent is subject to a terminal disclaimer.

(21) Appl. No.: 13/405,812

(22) Filed: Feb. 27, 2012

(65) Prior Publication Data

US 2013/0225324 A1 Aug. 29, 2013

(51) Int. Cl.

| | |
|---|---|
| ***A63B 37/04*** | (2006.01) |
| ***A63B 37/00*** | (2006.01) |
| ***A63B 37/12*** | (2006.01) |
| ***A63B 45/00*** | (2006.01) |
| *A63B 41/02* | (2006.01) |

(52) U.S. Cl.

CPC ..... *A63B 37/0003* (2013.01); *A63B 37/0039* (2013.01); *A63B 37/12* (2013.01); *A63B 41/02* (2013.01); *A63B 45/00* (2013.01); *A63B 2209/00* (2013.01); *A63B 2209/14* (2013.01)

USPC ..... 473/374; 473/351; 473/377; 473/409

(58) Field of Classification Search

USPC ..... 473/409, 371, 280, 352, 374

See application file for complete search history.

(56) References Cited

U.S. PATENT DOCUMENTS

| | | | | | |
|---|---|---|---|---|---|
| 1,533,563 | A * | 4/1925 | Sabatino | 264/36.12 |
| 2,079,615 | A * | 5/1937 | Holt et al. | 427/140 |
| 3,233,544 | A * | 2/1966 | Hosoya | 102/334 |
| 3,268,634 | A * | 8/1966 | Glaser | 264/36.12 |
| 4,614,340 | A * | 9/1986 | Hosoya | 473/376 |
| 5,098,104 | A * | 3/1992 | Kane | 473/372 |
| 5,389,169 | A * | 2/1995 | McRae | 156/98 |
| 5,390,932 | A * | 2/1995 | Russo, Sr. | 473/377 |
| 5,427,377 | A * | 6/1995 | Maruoka | 473/377 |
| 5,569,418 | A * | 10/1996 | Russo, Sr. | 264/36.12 |
| 5,609,535 | A * | 3/1997 | Morgan | 473/409 |
| 5,688,192 | A * | 11/1997 | Aoyama | 473/374 |
| 5,823,889 | A * | 10/1998 | Aoyama | 473/374 |
| 5,823,891 | A * | 10/1998 | Winskowicz | 473/378 |
| 5,913,736 | A * | 6/1999 | Maehara et al. | 473/360 |
| 5,938,544 | A * | 8/1999 | Winskowicz | 473/378 |
| 5,961,401 | A * | 10/1999 | Masutani et al. | 473/374 |
| 5,976,430 | A * | 11/1999 | Kataoka et al. | 264/36.12 |
| 6,186,906 | B1 * | 2/2001 | Sullivan et al. | 473/351 |
| 6,270,429 | B1 * | 8/2001 | Sullivan | 473/374 |
| 6,277,037 | B1 * | 8/2001 | Winskowicz et al. | 473/378 |
| 6,358,160 | B1 * | 3/2002 | Winskowicz | 473/378 |
| 6,595,875 | B1 * | 7/2003 | Oh | 473/374 |
| 6,623,382 | B2 * | 9/2003 | Winskowicz | 473/378 |

(Continued)

*Primary Examiner* — Gene Kim

*Assistant Examiner* — Matthew B Stanczak

(74) *Attorney, Agent, or Firm* — Honigman Miller Schwartz and Cohn LLP; Anna M. Budde; Jonathan P. O'Brien

(57) ABSTRACT

A ball includes a core, a cover, and cracking element or cracking layer. The cracking layer may be deformed or actuated to create discontinuities in the cover. The creation of discontinuities allows for easier recycling of the ball parts. The cracking layer may include one of a bladder or a hydrophilic material that expand upon the introduction of a fluid, a shape memory polymer that deforms upon application of a stimulus, or two materials that react chemically to form a gas.

4 Claims, 7 Drawing Sheets

(56) References Cited

U.S. PATENT DOCUMENTS

| | | | | |
|---|---|---|---|---|
| 6,833,098 | B2 * | 12/2004 | Watabe et al. | 264/139 |
| 7,056,230 | B2 * | 6/2006 | Emalfarb | 473/351 |
| 7,204,290 | B2 * | 4/2007 | Watabe et al. | 156/750 |
| 7,244,193 | B2 * | 7/2007 | Emalfarb | 473/351 |
| 7,967,702 | B2 * | 6/2011 | Winskowicz et al. | 473/378 |
| 8,475,297 | B2 * | 7/2013 | Chou et al. | 473/371 |
| 8,479,796 | B2 * | 7/2013 | Ono | 156/760 |
| 8,480,516 | B2 * | 7/2013 | Cheng et al. | 473/409 |
| 8,647,467 | B2 * | 2/2014 | Molinari | 156/711 |
| 2002/0056932 | A1 * | 5/2002 | Watabe et al. | 264/36.12 |
| 2004/0209701 | A1 * | 10/2004 | Finkel | 473/280 |
| 2005/0227789 | A1 * | 10/2005 | Winskowicz et al. | 473/378 |
| 2006/0234812 | A1 * | 10/2006 | Ladd et al. | 473/371 |
| 2009/0221386 | A1 * | 9/2009 | Ladd et al. | 473/374 |
| 2012/0046126 | A1 * | 2/2012 | Chou et al. | 473/374 |
| 2012/0094785 | A1 * | 4/2012 | Cheng et al. | 473/409 |
| 2012/0231899 | A1 * | 9/2012 | Alan | 473/377 |
| 2012/0266433 | A1 * | 10/2012 | Ono | 29/426.5 |
| 2013/0165267 | A1 * | 6/2013 | Molinari | 473/377 |
| 2013/0225322 | A1 * | 8/2013 | Fitchett et al. | 473/368 |

* cited by examiner

BALL INCORPORATING ELEMENT FOR CRACKING COVER

FIELD

The present disclosure relates generally to a ball that incorporates a core, a cover, and a cracking element or cracking layer. More specifically, the present disclosure relates generally to a ball that incorporates at least one element that creates a patterned discontinuity on the cover to reduce the cost and effort of removing the cover to better enable the ball elements to be recycled.

BACKGROUND

It is desirable to recycle materials that still have useful life. Golf ball cores are typically made from materials that do not deteriorate as quickly as the covers which surround them. However, when the cover becomes scuffed, cut, or otherwise deteriorates, many golfers discard the ball and use a new ball for a more predictable performance.

However, only the cover has deteriorated in many instances, and the core can be recovered and reused or the materials in the core may be recycled in other ways. In some cases, the core may simply be recovered and reused in the same form and shape. In other cases, the core material or materials may be ground or otherwise reconditioned and combined with other such materials and reused. In some cases, the materials may be reconditioned to be formed into another ball core. In other cases, the materials may be recycled to be used for other purposes.

In many cases, the cover and the core are made from different materials and then are joined together. Frequently, an adhesive is used to ensure that the core and the cover remain in fixed relationship to one another. However, the use of such an adhesive creates difficulty in recycling.

The use of an adhesive creates two separate problems. First, the adhesive makes it difficult to separate the cover and the core. Also, the adhesive may need to be removed from both the cover and the core in order to recycle either or both materials. These two difficulties create a relatively high expense to recycle ball materials, which reduces the economic feasibility of doing so.

Accordingly, it is desirable to develop a ball where the cost to recycle the ball is minimized. If a ball design eases the difficulty in separating the core and cover, eases the removal of the adhesive from one or more of the materials, or both, the recycling cost is minimized, which enhances the desire and ability for golfers and manufacturers to recycle balls. The development of a ball that incorporates a material or layer to enable such recycling is desirable.

SUMMARY

In one embodiment, a ball includes a core, a cover, and a cracking element. The cover may be disposed radially outwardly of the core. The intermediate layer may be disposed between at least a portion of the cover and at least a portion of the core. The cracking element may be positioned within the ball and may be capable of creating at least one crack on the cover upon application of a stimulus. The cracking element may be positioned within the cover or may form a part of or the entirety of the intermediate layer.

In another embodiment, a layered article includes an innermost layer, an intermediate layer, an outermost layer, and a cracking layer. The outermost layer may be radially outward of the innermost layer. The cracking layer may be disposed within the layered article.

In another embodiment, a method of preparing a golf ball for recycling may include the steps of providing a golf ball and deforming a cracking layer. The golf ball may have at least one core layer, at least one cover layer, and a cracking layer. The deformation of the cracking layer may minimize the effort required to remove the at least one cover layer from the at least one core layer.

The present embodiments disclose a structure and method that may be used to reduce the cost and effort required to recycle one or more golf ball layers. The cost and effort may be reduced when the various layers may be separated with greater ease. Because various golf ball layers are made from different materials, they typically cannot be recycled together. When the layers may be easily separated, they may be more easily recycled separate from one another. Often, the core of the golf ball is the most recyclable, and what is desirable is to separate the core from the remaining layers, particularly the cover.

Accordingly, a cracking element or cracking layer may be included in the ball. The cracking element or cracking layer is configured to create a crack or other discontinuity on a surface of a cover to reduce the effort necessary to separate the layers. The cracking layer may be deformed or activated by another force or material, such as a temperature change or the introduction of a fluid. This deformation or activation may separate the core and the cover.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
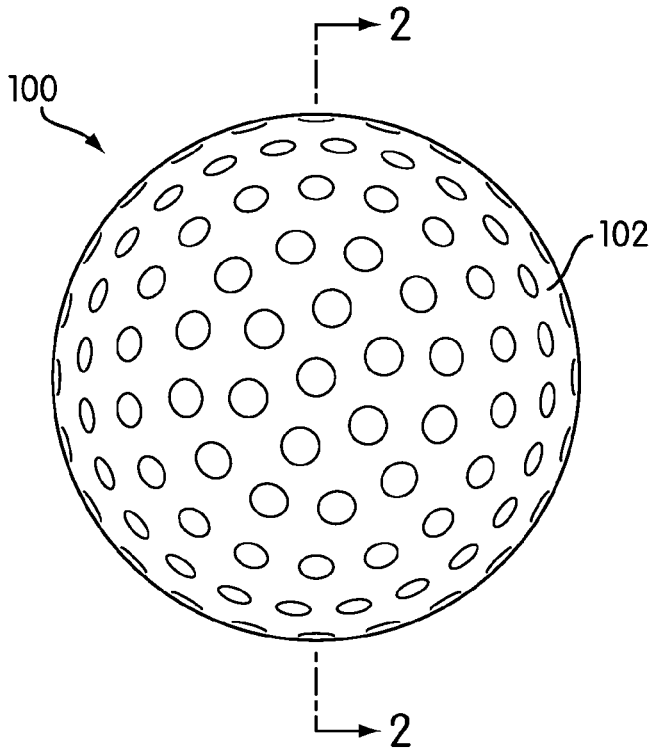
FIG. 1 is a side view of a ball according to the present disclosure.

FIG. 1 is a side view of a ball 100 that may be used in accordance with the embodiments disclosed herein. FIG. 1 shows a generic dimple pattern applied to outer surface 102 of ball 100. While the dimple pattern on ball 100 may affect the flight path of ball 100, a designer may select from any appropriate dimple pattern to be applied to ball 100.

Figure 2:
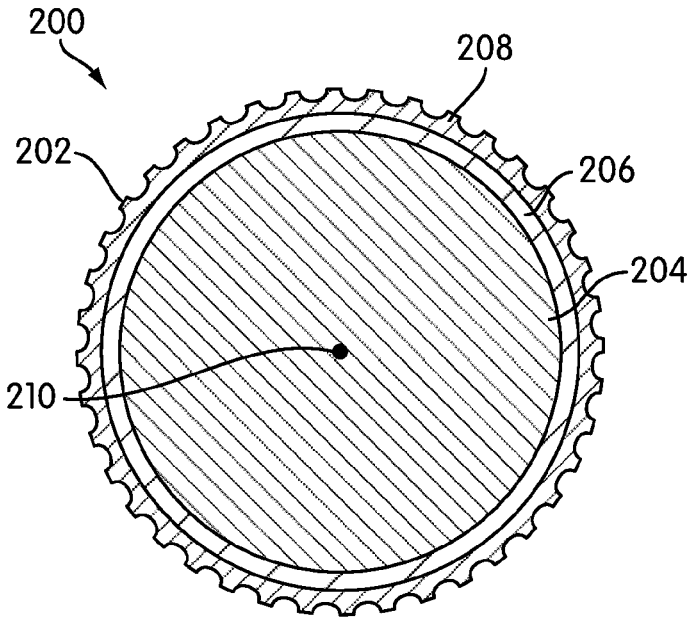
FIG. 2 is a cross-section of the ball of FIG. 1 taken along line 2-2.

FIG. 2 is a cross-sectional view of a ball 200. Ball 200 may have three layers. The innermost layer may be core 204. Surrounding and disposed radially outwardly from core 204 may be intermediate layer 206. Surrounding and disposed radially outwardly from intermediate layer 206 may be outermost layer or cover 208.

FIG. 2 shows the cross section in simplified form. A person having ordinary skill in the art is aware that in golf ball or other layered article applications, core 204 may have a plurality of layers. For example, core 204 may have an inner core layer, an outer core layer, and an intermediate core layer between the inner core layer and the outer core layer. In addition, cover 208 may have a plurality of layers. For example, cover 208 may include an inner cover layer, an outer cover layer, and an intermediate cover layer. In other examples, core 204 and/or cover 208 may each have two layers, four layers, or any other number of layers thought desirable by a person having ordinary skill in the art. Core 204 and cover 208 need not have the same number of layers. In some embodiments, a mantle layer may also be included. In addition, in some instances, a top coat, printed indicia, or the like, are applied to cover 208 and may be considered to be a part of cover 208.

FIG. 2 is also simplified in its reference to the layers that are positioned on either side of intermediate layer 206. While intermediate layer 206 is shown and described herein as a layer separate from core 204 or cover 208, intermediate layer 206 may instead be one of the core layers or one of the cover layers which is positioned intermediate the innermost core layer and the outermost cover layer. In the present disclosure, the layers that are positioned between centerpoint 210 of ball 200 and intermediate layer 206 may be referred to as the core. Also in the present disclosure, the layers that are positioned between the outer surface 202 of ball 200 may be referred to as the cover. However, intermediate layer 206 need not be positioned between what a person having ordinary skill in the art would term the "core" or "core layers" and the "cover" or "cover layers." One of the reasons the devices and methods disclosed herein may be used is to ease the separation of a ball, golf ball, or other layered article into two parts. Among the reasons this separation may be desirable is if one or more of the layers is to be treated different from others of the layers. For example, in some instances, the material used to form one or more layers of a golf ball core may be recycled, while the material used to form the outermost cover layer may not be recycled or may be recycled in a different method or way. However, with some balls or layered articles, it may be that it is most advantageous for a cracking layer or an intermediate layer to fall between two of the core layers or two of the cover layers, as in some instances, it may be that only, for example, the innermost core layer is treated differently from the remaining layers, and that therefore, it is most desirable to separate this one layer from the remaining layers. Accordingly, when this disclosure refers to or illustrates the cracking element or the cracking layer or the intermediate layer being positioned between the core and the cover, it is to be understood that the position of such a layer may be between any two layers of the golf ball outside of the innermost core layer and inside the outermost cover layer, depending on the various materials used for each layer and the desires of a particular designer. The description and illustration of a single core layer and single cover layer are used merely for ease of description, illustration, and understanding.

Figure 3:
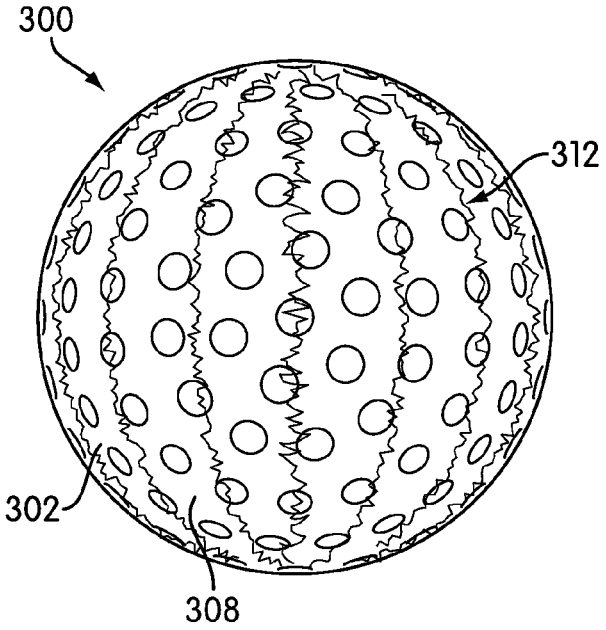
FIG. 3 is a side view of a ball showing a desirable pattern of discontinuities or cracks on a cover of a ball.

Turning now to FIG. 3, a pattern of cracks 312 is shown on an outer surface 302 of a golf ball 300. The pattern 312 is similar to that of the sections of an orange. This pattern 312 may be a desirable cracking pattern of a cover 308. When cover 308 cracks in a pattern similar to pattern 312, it may allow cover 308 to be more easily removed from the remainder of ball 302. In some commonly used recycling equipment, cover 308 may be stripped from interior layers of ball 302. The creation of cracks or discontinuities 312 may allow a cover stripping machine to more easily grasp cover 308 by insertion of a finger or other element through a crack or discontinuity 312. In some embodiments, it may be desirable to mold the layers of ball 302 to create a weakened area in cover 308 in such a pattern. For example, an inner cover layer may have a hardness different from a hardness of the outer cover layer. The inner cover layer may be designed and molded to incorporate ridges on its exterior surface. When the outer cover layer is overmolded, it may have an inconsistent thickness, due to the ridges on the inner cover layer. This inconsistent thickness may create a discontinuity of hardness, causing a predictable cracking pattern on the exterior surface when subjected to adequate force from within or without.

Figure 4:
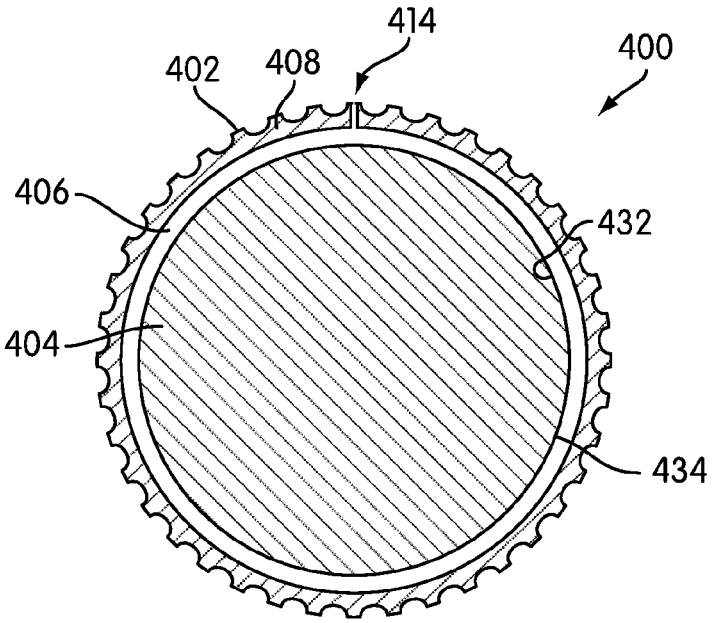
FIG. 4 is a cross-sectional view of a ball using a bladder as an cracking layer.
Figure 5:
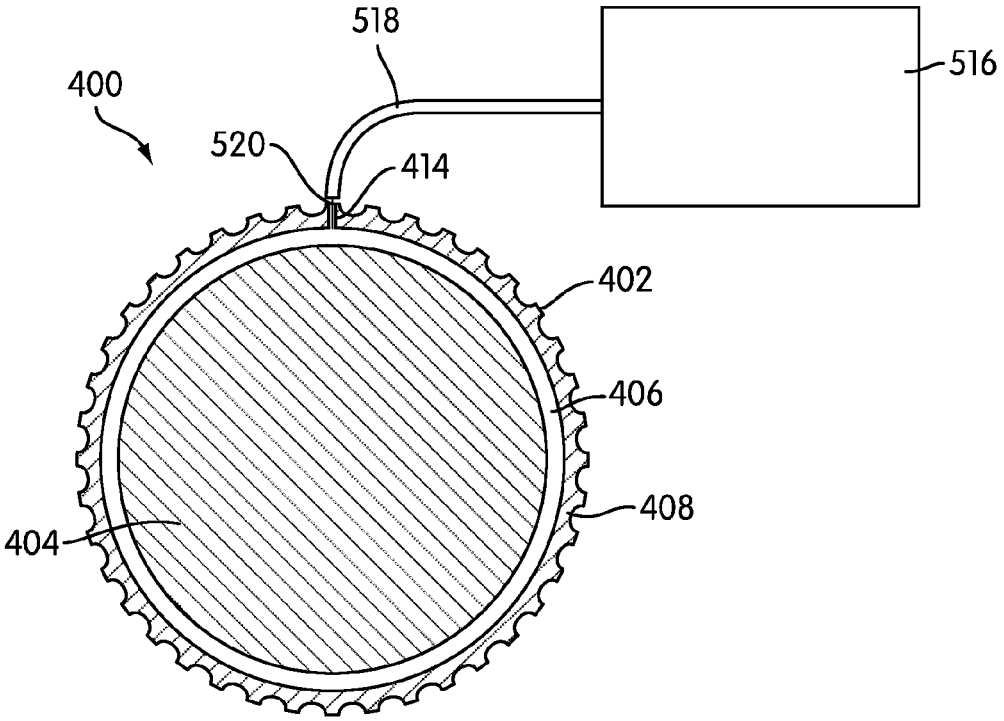
FIG. 5 is a cross sectional view of the ball of FIG. 4 showing the application of a stimulus.

Turning now to FIGS. 4 and 5, one embodiment of an intermediate layer is shown. FIG. 4 shows a ball 400 that may include a core 404, a cover 408, and an intermediate layer 406. As shown in FIGS. 4 and 5, intermediate layer 406 may serve as a cracking element or cracking layer. Intermediate layer 406 may be positioned radially outwardly of core 404 and cover 408 may be positioned radially outwardly of intermediate layer 406. A port 414 may be positioned on ball 400 and may allow fluid communication between intermediate layer 406 and the outer surface 402 of ball 400. Port 414 may be embedded within cover 408 in some embodiments.

In some embodiments, port 414 may be configured in a manner similar to a basketball valve. In other embodiments, port 414 may be configured as another type of valve. In many embodiments, it is desirable for port 414 to be a one-way, sealable valve. Because the introduction of one or more fluids into port 414 may initiate cracking of the cover, it may be desirable for port 414 to include a mechanism to keep fluids away from intermediate layer 406 until it is desired to insert such a fluid.

In an embodiment with a port 414, intermediate layer 406 may be a bladder or a hydrophilic material. FIG. 5 illustrates in simplified form a structure that may be used to actuate or deform intermediate layer 406. When it is desired to separate core 404 from cover 408, a pump 516 may be attached to port 414. In some instances, pump 516 may be connected to a fluid transmission device 518, such as a tube, which may include a nozzle 520 at its free end. Nozzle 520 may be desirably designed to mate with valve 414 to form a fluid-tight seal. Pump 516 may be any of a variety of types of devices that are capable of injecting a fluid into intermediate layer 406. In some embodiments, the fluid injected into intermediate layer 406 may be a liquid, and in other embodiments, the fluid may be a gas. In some embodiments, the liquid may be water.

In some embodiments, intermediate layer 406 may be a bladder. When intermediate layer 406 is a bladder, it may be desirable for port 414 and nozzle 420 to be configured in a manner similar to other devices used for filling bladders using pumps. For example, port 414 may be configured in a manner similar to inflatable balls, such as basketballs. Such a port is often designed as a rubber or resin cylinder with a relatively small diameter opening. Such a valve may be a one-way valve. In the present disclosure, no fluid is present in the bladder before it is inserted by the pump, and when fluid is inserted, nozzle 520 may fully block port 414. Accordingly, no one-way device may be necessary in many embodiments. In some embodiments, it may be desirable for port 414 to be integrally formed with bladder 406 and that port 414 and bladder 406 be made from resilient materials so that bladder 406 and port 414 are not damaged when the ball 400 is subjected to the typical stresses of play.

The use of a bladder 406 may differ from a typical situation where a bladder is filled with a fluid. While in the context of a basketball or other inflatable ball containing a bladder, the needle shaped nozzle may positioned anywhere in the interior of the bladder, in the context of a layered ball, there is no large cavity into which the free end of nozzle 520 would fit. Accordingly, in many embodiments, nozzle 520 may be shaped and sized precisely to extend through cover 408 and to extend only as far as bladder 406. In other embodiments, nozzle 520 may extend only slightly into port 414. In many embodiments, nozzle 520 may be prevented from extending through bladder 406 into core 404, as the injection of fluid into core 404 may be disadvantageous in many embodiments.

Bladder 406 may take one of a variety of forms. Typically, a bladder is a relatively fluid tight compartment that is inflatable with air or another fluid. Examples include such items as inflatable balls, hot water bottles, and even balloons. Many bladders are formed of rubber or another flexible and resilient material that may be capable of expanding when fluid is inserted into a cavity within the bladder. However, in some embodiments, bladder 406 need not take such a form.

Upon application of a stimulus, cracking element or cracking layer 406 may deform and may create at least one crack on cover 408. As shown in FIG. 5, pump 516 or other device for injecting a fluid into intermediate layer 406 may be provided. An intermediate tube or conduit 518 may be attached to pump 516 to move the fluid from pump 516 to nozzle 520 and valve 414. In some embodiments, pump 516 may be unnecessary and adequate water pressure may be found, for example, from a public water source. In other embodiments, conduit 518 may be unnecessary. In other embodiments, a specifically designed nozzle 520 may be unnecessary.

The pumping or insertion of the fluid into intermediate layer 406 may cause the expansion of intermediate or cracking layer 406. The expansion of cracking layer 406 through the insertion of a stimulus, such as the fluid, may be considered to be deforming cracking layer 406. As intermediate layer 406 expands due to its activation through the input of a stimulus fluid from nozzle 520, intermediate layer 406 may put inward pressure on core 404 and outward pressure on cover 408. In some embodiments, core 404 may be more compressible than cover 408. In such an embodiment, the deformation of intermediate layer 406 may compress core 404 until the force that is applied on the inward side of intermediate layer 406 by core 404 and the force applied on the outward side of intermediate layer 406 by cover 408 become about equal. Once these two forces become equal, further deformation of the core 404 may become unlikely, and further deformation or expansion of intermediate layer 406 may tend to produce an outward force on cover 408. As the outward force continues, the deformation of intermediate layer 406 may create discontinuities in cover 408. Cover 408 may develop discontinuities or cracks in one or a variety of places. FIG. 3 shows an exemplary pattern of discontinuities or cracking pattern 312 on ball 400. Cracking pattern 312 is exemplary of a cracking pattern that may be produced by producing a series of weakened areas in cover 408, as described earlier in connection with FIG. 3, or through the use of a bladder using a series of arms extending around core 404 in a pattern similar to discontinuity pattern 312. Other cracking patterns may also be obtained through the use of alternative designs for the cover or the intermediate layer.

Figure 6:
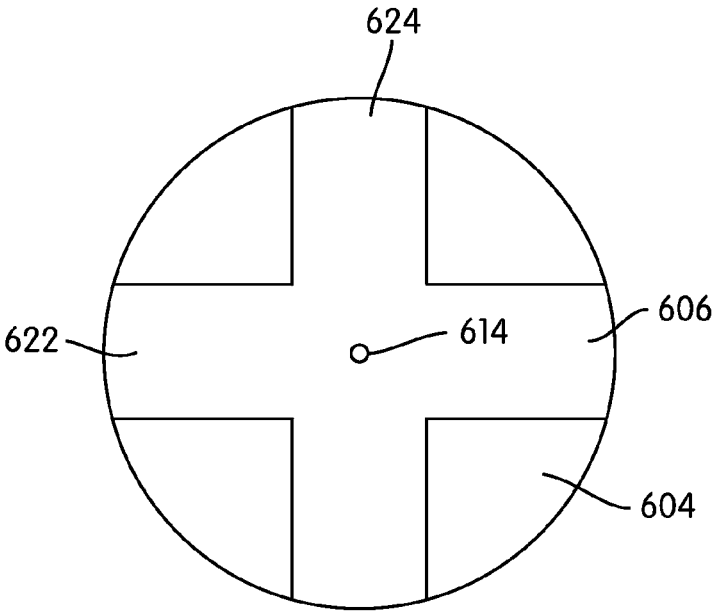
FIG. 6 is a top view of a core and an alternative bladder as at least a portion of an intermediate layer.
Figure 7:
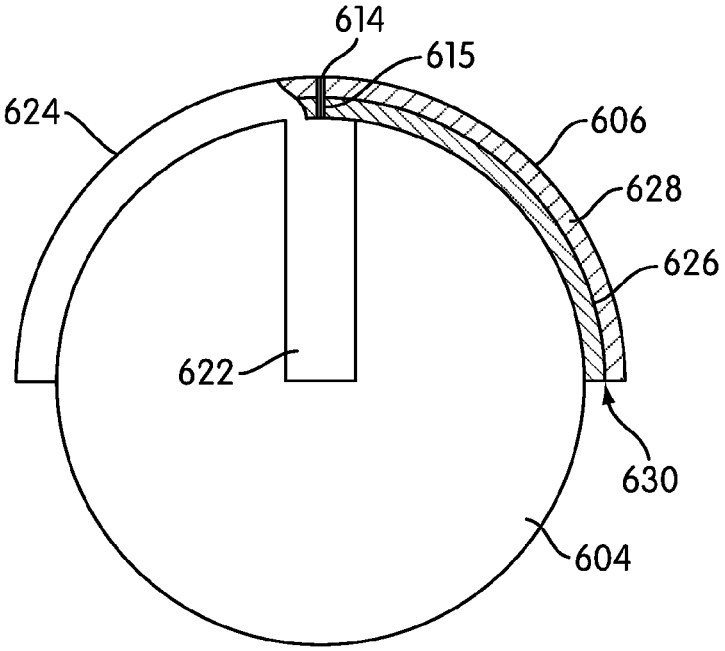
FIG. 7 is a side view of the structure of FIG. 6.

FIGS. 4 and 5 illustrate a bladder 406 that substantially or completely surrounds core 404. However, for ease of manufacturing or for other reasons, bladder 406 may instead take the form of one or a plurality of strips, each of which partially or completely surrounds core 404. FIGS. 6 and 7 illustrate an embodiment of a bladder that includes only strips and that only partially surrounds the core. In FIGS. 6 and 7, cracking layer or bladder 606 may partially surround and may be positioned radially outwardly from core 604. In FIGS. 6 and 7, cracking element or cracking layer 606 may have an X-shape and may extend about half way around a circumference of core 604. Cracking layer 606 may include two arms, first arm 622 and second arm 624. Port 614 may be integrally formed with cracking layer 606. FIG. 7 is a side view of the core and cracking layer of FIG. 6. FIG. 7 is partially in section, showing that the bladder 606 may be formed of an inner layer 626 and an outer layer 628 joined along their peripheral edge 630. In FIGS. 6 and 7, no cover is shown in order to better view the configuration of bladder 606. However, a cover may be added over bladder 606 in many embodiments. As is further shown in FIG. 7, port 614 may include a narrow opening 615 into which nozzle 520 may be inserted to insert the fluid between inner layer 626 and outer layer 628. While these details are not shown in FIG. 4, it will be apparent to one of ordinary skill in the art that if a bladder is used in FIG. 4, it may have an inner layer and an outer layer and that the layers may desirably be secured to one another so that the two layers do not rotate relative to one another.

Cracking layer 606 is shown in FIGS. 6 and 7 in a manner to simplify description. Cracking layer 606 may form a part of or may be embedded within a layer that completely surrounds core 604. Such a cracking layer 606 embedded within an intermediate layer may be formed, for example, by using a bladder like that shown in FIGS. 4 and 5 that includes a seal between the plies of the bladder in the form shown in FIGS. 6 and 7. Alternatively, the bladder may be placed in a mold over core 604 and additional material may be injected to surround the remainder of the surface of core 604 to embed cracking layer 606 in an intermediate layer.

Various configurations of a bladder are, therefore, possible. The bladder may be configured with any number of arms that may completely or partially cover the core. The bladder may have a peripheral edge that is any form of closed curve that partially covers the core. For example, the peripheral edge could be circular and the bladder could form a semi-sphere that covers about a half of the core. Any configuration is possible, depending on the desired cracking pattern and the desires of the designer in creating a ball with desired performance characteristics. While a configuration with four arms is shown, any number of arms may be appropriate and the thickness of the arms may vary from that shown. The example shown is merely one example.

Figure 8:
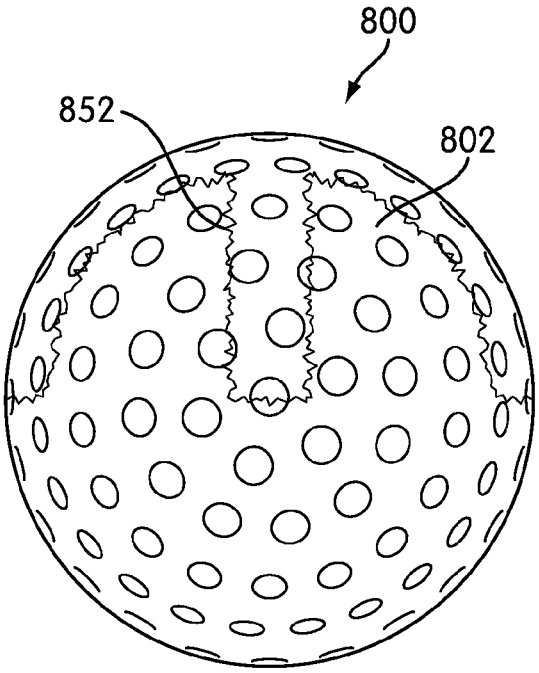
FIG. 8 is an exemplary pattern of discontinuities on a ball cover which may be created by the embodiments of FIGS. 6 and 7.

When it is desired to deform cracking layer 606, the method shown and described in connection with FIG. 5 above may be used. As a stimulus, such as a fluid or liquid, is inserted into cracking layer 606, cracking layer 606 may deform by expanding. The deformation of cracking layer 606 through the introduction of the stimulus may eventually cause cracking layer 606 to produce an outward force on the surrounding cover. This force may create at least one crack on the cover. FIG. 8 shows a cracking pattern 852 that could be created based on the configuration of a cracking layer 606 as shown in FIGS. 6 and 7. Because cracking layer 606 may be discontinuous or may be asymmetrical around core 604, in many embodiments, cracking pattern 852 may also be discontinuous or asymmetrical around surface 802 of ball 800. A person having ordinary skill in the art may use any of the embodiments shown herein to create a specific desired cracking pattern based on the selection of a particular configuration of cracking layer within one of the other ball layers by making similar modifications to those embodiments.

Returning to FIG. 4, in some embodiments, intermediate or cracking layer 406 may be a layer of hydrophilic material. A hydrophilic material is one that absorbs water. Other equivalent materials that absorb other fluids may also be used, if it is desired to use a fluid other than water. The term "hydrophilic" is used in the disclosure as a short hand version for any material that absorbs a fluid, and the term "water" is used in the disclosure as a short hand version for a fluid that is appropriate for the corresponding material. If a hydrophilic material is used as intermediate layer 406, port 414 may be used to inject a stimulus, such as water, into intermediate layer 406. Many hydrophilic materials are resins that may be easily molded onto core 404 in conventional golf ball molds. Accordingly, intermediate layer 406 may be molded like another layer. However, if a hydrophilic material is used, it may be more complicated or impossible to integrally mold or embed a segment that extends through cover 408 to outer surface 402 to be used like port 414. In such an instance, it may be desirable to include or embed a valve or port 414 that is made of a different material when molding the cover 408. Valve 414 may extend from outer surface 402 to intermediate layer 406.

It may be possible in some embodiments for intermediate layer 406 to be a cavity. If intermediate layer 406 is a cavity, it may be desirable for core 404 or cover 408 to include a plurality of spaced fingers to place core 404 and cover 408 in a generally fixed spaced relationship to one another, as in many embodiments, it may be undesirable for core 404 to change in position within ball 400, because such changes in position may adversely affect the flight path of ball 400. In some embodiments, it may be possible for port 414 to simply extend from an outer surface to a desired depth between two golf ball layers and to use those two layers in lieu of the bladder of FIG. 4.

The fluid or stimulus selected to be used in the intermediate layer may have a secondary purpose. The secondary purpose may be to dissolve adhesives. In some embodiments, the various layers of the ball may be secured to one another with an adhesive coating. This adhesive coating may be present between the core and the cover, and there may be an adhesive coating on each side of the intermediate layer. The presence of adhesive may, in some embodiments, create complications in recycling one or more layers of the ball. Accordingly, if the fluid chosen is capable of reacting chemically with the adhesive and enhancing the release of the adhesive from the layer or layers to be recycled, the use of such a fluid may be advantageous. For example, and referring again to FIG. 4, if an adhesive that is soluble in water is used on the outside of core 404, a hydrophilic material may be used as intermediate layer 406 and water may be selected as the fluid to be used. As the water is absorbed by intermediate layer 406, some water may be transmitted to inner surface 432 of intermediate layer 406 adjacent outer surface 434 of core 404. The presence of water may tend to dissolve any adhesive from outer surface 434 of core 404 while intermediate layer 406 is undergoing deformation. Accordingly, this selection of fluid may reduce or eliminate a step of removing the adhesive in another, later step. In an alternative embodiment, the fluid used may be acetone or another solvent that may assist in releasing the adhesive.

Figure 9:
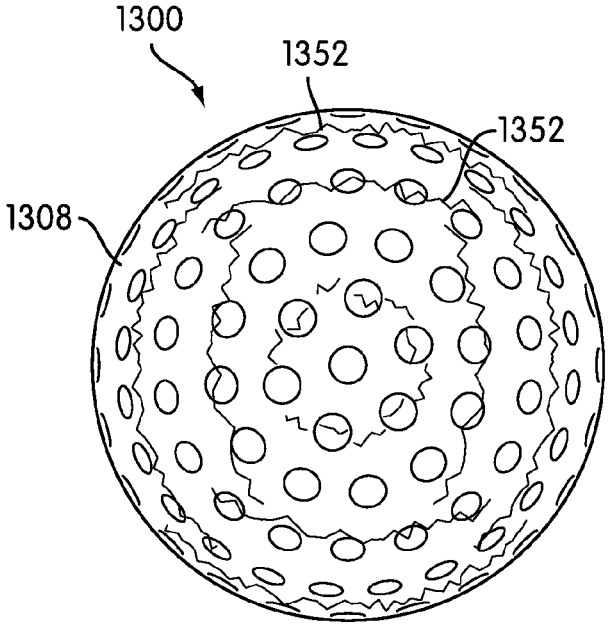
FIG. 9 is a side view of a ball according to the present embodiments showing an alternative pattern of discontinuities on the ball cover.

The precise pattern of discontinuities or cracks as shown above is only one embodiment of such a pattern. The cracking pattern can be a different cracking pattern. Another example of a cracking pattern is shown in FIG. 9. FIG. 9 shows a plurality of cracks 1352 on cover 1308 of ball 1300. The cracks 1352 have a different pattern than those shown in connection with any of the earlier embodiments. However, these illustrative embodiments are merely illustrative. The cracks or discontinuities in the cover created by any of the structures and methods disclosed herein may have any pattern that is desirable. It may be desirable for any crack or other discontinuity formed with the structures and methods disclosed to be sufficient to allow a conventional machine to more easily strip the cover from the core. In many embodiments, even a small discontinuity in the cover may be sufficient to reduce the effort necessary to recycle the ball portions.

In another embodiment, as shown in FIGS. 10-13, the intermediate layer may be formed of a shape memory material. Shape memory materials are typically formed of a polymer or a wire or metal. However, nanotube-based materials and other materials may also exhibit shape memory characteristics. As a general principle, shape memory materials are ones that have an initial shape, are heated to become thermoplastic and to be molded to have a desired shape. The formed product is then exposed to a stimulus which causes the shape memory material to return to its original shape. The stimulus that causes the return may be heat, light, or electricity, based on the material used. However, as developments in this area are ongoing, when the present disclosure discusses a shape memory material and a stimulus, it intends to encompass all versions of shape memory materials that are meaningful in the present embodiments and all relevant stimuli that actuate or deform the shape memory materials. An example of a thermoplastic shape memory polymer that uses heat as a stimulus is NORSOREX® available from Zeon Chemicals. An example of a shape memory metal is NITINOL, available from NDC in Fremont, Calif. In the context of a golf ball, given the relatively high melt temperatures of the materials used, it may be desirable to use a material that returns to its original shape when heat is applied.

A shape memory polymer or metal may be formed or shaped from an initial, planar shape to conform to the shape of a ball. If a sheet-like material is used, the shape memory material may form an intermediate layer like that shown as intermediate layer 206 of FIG. 2. If, instead, strips of shape memory polymer are used, or if a shape memory metal is made into wire or strips, the wire may be positioned as arms extending partially or fully around the ball. If such a configuration is used, it may have an appearance similar to intermediate layer 606 shown in FIGS. 6 and 7. The ball is then formed in the same manner as in connection with the previously described embodiments.

Figure 10:
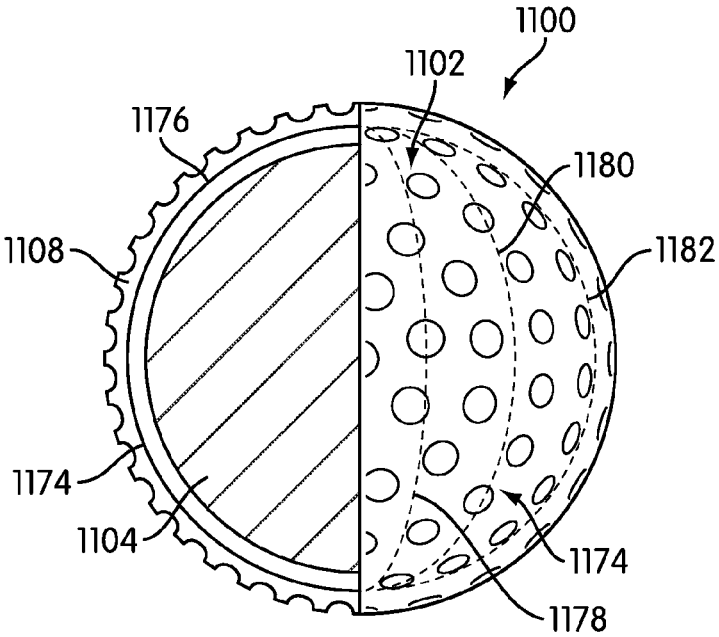
FIG. 10 is a side view, partially in cross-section, of a ball using a plurality of strips of a shape memory material as a cracking layer within an cover layer.
Figure 11:
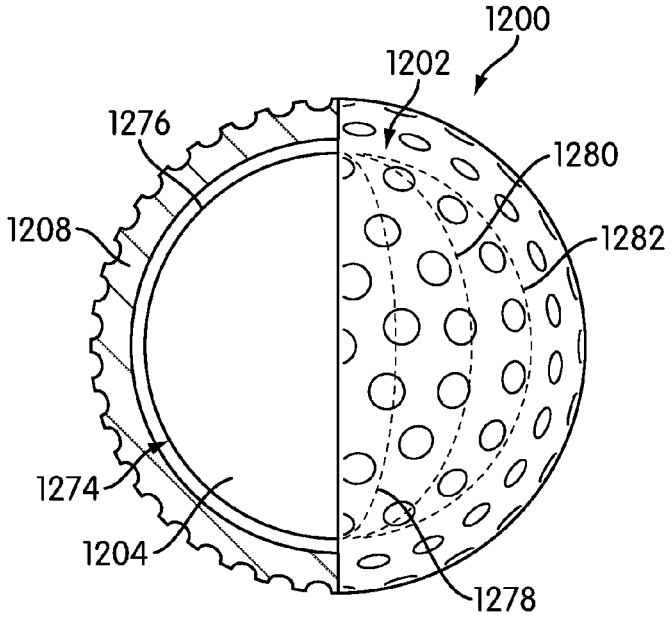
FIG. 11 is a side view, partially in cross-section, of a ball using a plurality of strips of a shape memory material as a cracking layer within a core layer.

FIGS. 10 and 11 show the use of a cracking element or cracking layer embedded within a cover layer and a core layer, respectively. In the embodiment shown in FIGS. 10 and 11, the cracking layer may be a series of shape memory wires or a series of strips of shape memory polymer. In molding the ball, the strips or wires forming the cracking layer may be suspended or otherwise placed into a mold while one of the layers of the ball is being molded and the material used to mold that layer may surround the cracking layer, thereby embedding the cracking layer within another layer of the ball. Alternatively, the strips of material may be joined to one another so that they can be wrapped around a ball layer and then another layer overmolded onto the interior layer and the cracking layer. In some embodiments, heat or pressure or another molding technique may be used to apply the cracking layer onto or within a ball layer. In the embodiments shown in FIGS. 10 and 11, the cracking pattern created by the cracking layer may be similar to that shown in FIG. 3.

Turning first to FIG. 10, ball 1100 may include a core 1104 and a cover 1108. As noted above, core 1104 and cover 1108 may include multiple layers, and optional layers, such as a mantle layer, may also be included. Embedded within cover 1108 may be cracking layer 1174. Cracking layer 1174 may include a plurality of strips or wires that may be capable of deforming upon application of a stimulus. Cracking layer 1174 is illustrated as including first cracking element 1176, second cracking element 1178, third cracking element 1180, and fourth cracking element 1182. Cracking layer 1174 may include fewer or more than four cracking elements, depending on the desired cracking pattern to be formed on outer surface 1102 of ball 1100. FIG. 10 is shown partially in section. As shown in the section, cracking layer 1174 may be embedded within cover 1108. In some embodiments, cracking layer 1174 may be positioned between two cover layers and in other embodiments, cracking layer 1174 may be positioned or embedded within a cover layer. In some embodiments, one cracking element, such as first cracking element 1176, may be positioned differently from another cracking element, such as second cracking element 1178. In some embodiments, it may be desirable to position cracking layer 1174 adjacent core 1104.

Turning next to FIG. 11, ball 1200 may include a core 1204 and a cover 1208. As noted above, core 1204 and cover 1208 may include multiple layers, and optional layers, such as a mantle layer, may also be included. Embedded within core 1204 may be cracking layer 1274. Cracking layer 1274 may include a plurality of strips or wires that may be capable of deforming upon application of a stimulus. Cracking layer 1274 may be illustrated as including first cracking element 1276, second cracking element 1278, third cracking element 1280, and fourth cracking element 1282. Cracking layer 1274 may include fewer or more than four cracking elements, depending on the desired cracking pattern to be formed on outer surface 1202 of ball 1200. FIG. 11 is shown partially in section. As shown in the section, cracking layer 1274 is embedded within core 1204. In some embodiments, cracking layer 1274 may be positioned between two core layers and in other embodiments, cracking layer 1274 may be positioned or embedded within a core layer. In some embodiments, one cracking element, such as first cracking element 1276, may be positioned differently from another cracking element, such as second cracking element 1278. In some embodiments, it may be desirable to position cracking layer 1274 adjacent cover 1208.

In other embodiments, a cracking layer made up of individual cracking elements may be positioned as a separate layer intermediate the core layers and the cover layers. In such an embodiment, the cracking elements may be placed around the core in a manner similar to that shown in FIGS. 10 and 11.

Figure 12:
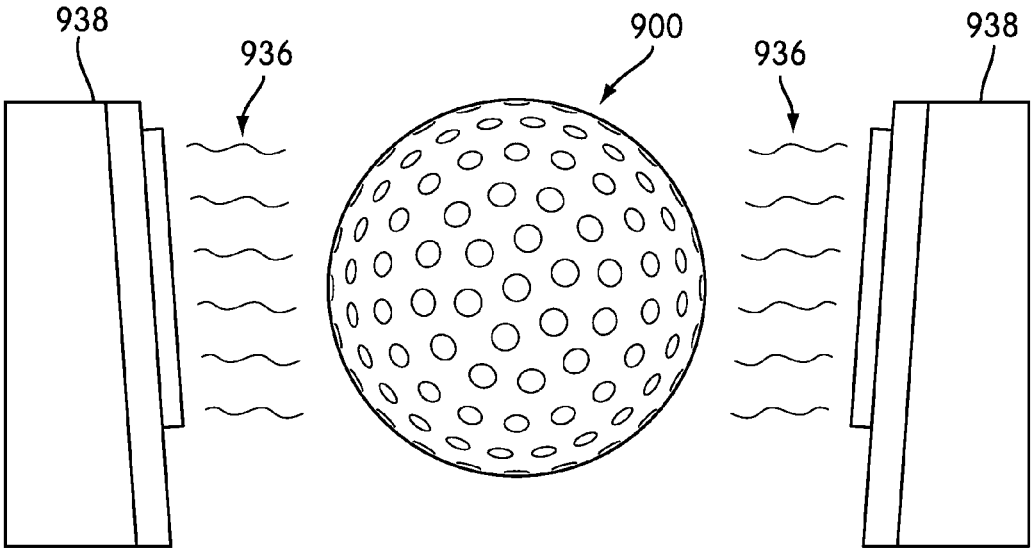
FIG. 12 is a side view of a ball according to the present embodiments showing the application of an alternative stimulus.

Turning now to FIG. 12, when it is desired to create at least one crack or discontinuity on the cover of a ball, ball 900 is subjected to a stimulus. In FIG. 12, the stimulus is shown as being heat 936 from an oven 938. As noted earlier in the disclosure, the stimulus may be one of a variety of stimuli. Only this stimulus is shown, but any of the stimuli noted can be used. When ball 900 is subjected to the stimulus, the cracking layer may be actuated or deformed. Many shape memory materials function in a manner whereby the material "remembers" its original shape. The material is subjected to a stimulus, such as heat, and may become plastic and able to be shaped to conform, for example, to a surface of a ball layer. When the material is subjected to the same stimulus, it may attempt to return to its original shape, such as a flat, planar shape. The method of and structure for heating and thermoforming the shape memory material is not shown or described herein, but is well known to people having ordinary skill in the art. Accordingly, any conventional method may be used as long as the final product, ball 900, functions in the manner herein described and illustrated.

Figure 13:
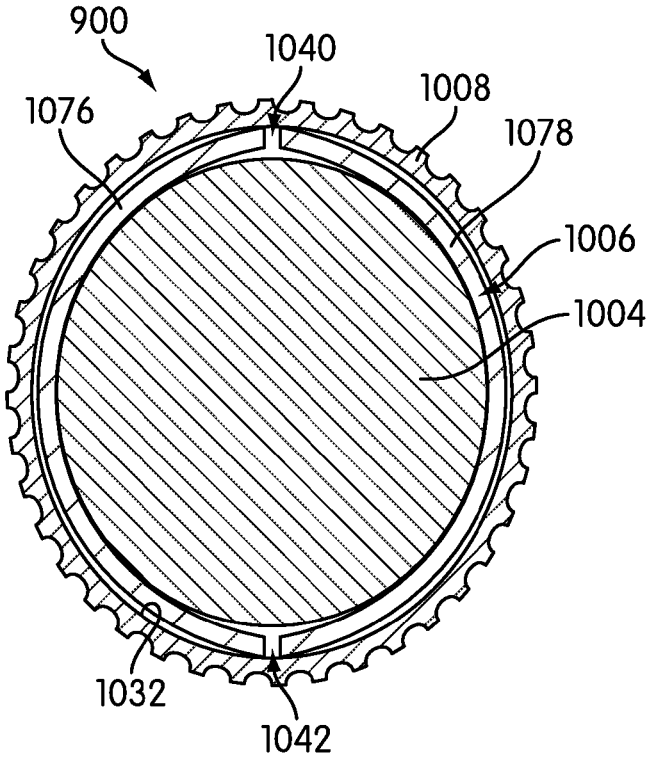
FIG. 13 is a cross-sectional view of a ball according to the disclosure to which the stimulus of FIG. 12 has been applied.

FIG. 13 shows a ball 90 which may include a core 1004 with an intermediate or cracking layer 1006 partially surrounding core 1004 and a cover 1008 partially surrounding intermediate layer 1006. Intermediate layer 1006 may be a shape memory polymer or a shape memory metal that has undergone the heat treatment of FIG. 12. In the example shown in FIG. 13, the original shape of the shape memory material may be cylindrical. This shape may not be required, however. In other embodiments, other shapes may be used. For example, in some embodiments, it may be desirable to have an initial shape similar to a FIG. 8 or infinity sign or other desirable shape. In other embodiments, the use of strips or wires of shape memory material may be used. An appropriate shape may vary depending on the precise material used as the shape memory material and its degree of plasticity when it is molded as a layer on ball 900. For ease of manufacturing in some embodiments, the shape memory material may begin initially as a flat sheet that may be wrapped around a circumference of core 1004 and then may be conformed completely to core 1004. However, any desirable manufacturing process may be used.

FIG. 13 illustrates a ball 900 similar to those shown in FIGS. 10 and 11. Ball 900 shows a cracking layer 1006 positioned as an intermediate layer between core 1004 and cover 1008. As noted above, because cracking layer 1006 may include a plurality of cracking elements, such as first cracking element 1076 and second cracking element 1078, cracking layer 1006 may be embedded within an intermediate layer. As shown in FIG. 13, when ball 900 is actuated by or subjected to an appropriate stimulus, such as the heat treatment shown in FIG. 12, intermediate layer 1006 may deform by deforming in an effort to return to its original configuration. In the embodiment shown in FIG. 13, the original configuration of cracking layer 1006 may be a plurality of planar strips or wires. In many embodiments, the composition and configuration of cover 1008 may be such that cracking layer 1006 cannot return to its original configuration, as it may not have adequate strength to adequately deform cover 1008 to the degree necessary to return to its original shape. In such an embodiment, as is shown in FIG. 13, cracking layer 1006 may deform enough to separate at first edge 1040 and second edge 1042. First edge 1040 and second edge 1042 may press against an inner surface 1032 of cover 1008 and deform cover 1008 to create additional separation between cover 1008 and core 1004. The materials selected for use as cracking layer 1006 and cover 1008 may be selected with appropriate strengths and deformabilities to prevent cracking layer 1006 from completely removing cover 1008 from core 1004, while still allowing the deformation of cracking layer 1006 to apply adequate force to cover 1008 to create at least one discontinuity or crack upon application of a stimulus. When such a crack is created, core 1004 may be more easily separated from the remaining layers 1006 and 1008. The configuration of cracking layer 1006 may be designed to create a cracking pattern like that shown in any of the earlier FIGS. or another desired cracking pattern.

Figure 14:
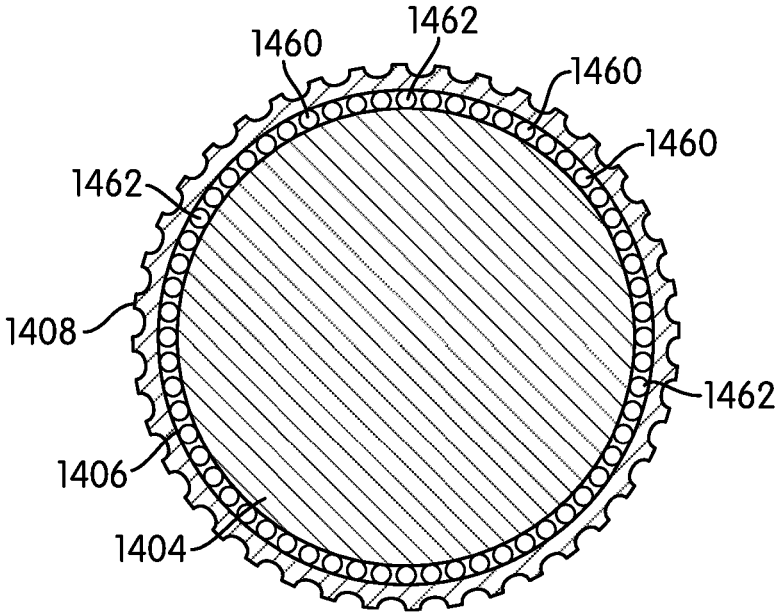
FIG. 14 is a cross-sectional view of another embodiment of a ball according to the present disclosure.

In another embodiment, the parts of the ball itself may create the force that causes the cracking or discontinuity of the cover. In the embodiment shown in FIG. 14, ball 1400 may include a core 1404, an intermediate and cracking layer 1406 surrounding and disposed radially outwardly of core 1404, and a cover 1408 surrounding and disposed radially outwardly of intermediate layer 1406. In this embodiment, cracking layer 1406 may include two materials, a first material and a second material, wherein the first material is separated from the second material by a physical barrier until the ball is impacted with sufficient force to remove the physical barrier when the first material and the second material chemically react to create a gas. The two materials included in cracking layer 1406 may produce a gas or other fluid when a chemical reaction between the two materials occurs. The pressure produced by the reaction may create an outward pressure on cover 1408 and may cause a discontinuity or cracking of cover 1408. In FIG. 14, cracking layer 1406 may include a plurality of capsules. A first subset 1460 of the capsules is at least partially filled with a first material. A second subset 1462 of the capsules is at least partially filled with a second material. First subset 1460 may be grouped together and second subset 1462 may be grouped together. Alternatively, and as shown, capsules in first subset 1460 and capsules in second subset 1462 may be interspersed. When at least one of the first subset 1460 breaks and at least one of the second subset 1462 breaks, first material and second material may react with each other. Depending on the materials used, different numbers of each of the first and second subset may need to break in order to create a sufficient pressure to create a discontinuity or crack in cover 1408.

In a relatively non-toxic example, the materials used could be vinegar and baking soda, which form carbon dioxide gas when they react. In some embodiments, ways of separating first material from second material other than by the use of small capsules of each may be useful. For example, the cracking layer could be separated into two superposed or adjacent layers, each of which contains one of the first material and the second material. In another alternative embodiment, one of the materials may be put into the capsules and the second material may be inserted around the capsules. In some embodiments, these materials may be further surrounded by a bladder with a port similar to that shown above for ease of filling with a liquid material.

In such an embodiment, the actuation of or application of a stimulus to cracking layer 1406 to deform cracking layer 1406 and cause a discontinuity in cover 1408 may be done in a plurality of ways. For example, a force may be applied to ball 1400 that is sufficient to break whatever barrier separates the two materials. This force may be a force applied after ball 1400 is returned for recycling. Alternatively, the capsules or other barrier may be designed to deteriorate over time with repeated strikes to the ball as may be common in golf and other sports. After a certain number of impacts, the capsule or barrier may become weakened in one or a plurality of areas and may open to allow first and second materials to combine. In such a system, the structures and methods described herein may have a further use to deform ball 1400 when it has been struck enough times that its play qualities have deteriorated and it should not be played any longer.

In another embodiment, only first material may form intermediate layer 1406. A port (not shown) similar to that described above in connection with FIGS. 4-7 may be included to extend from intermediate layer 1406 to outer surface 1402 of ball 1400. When it is desired to actuate the intermediate layer, a stimulus in the form of the second material may be injected through the port to start the chemical reaction.

In some embodiments, the materials chosen as first material and second material may be chosen to further accelerate the separation of the core and the cover. The materials may be selected so that one of the materials or one or more of the by-products of the chemical reaction tends to dissolve any adhesive used between the core and cover.

Regardless of the precise configuration used, it may be desirable in some embodiments to be able to predict or control when the chemical reaction will be initiated, particularly if the reaction is likely to occur when the ball is in use by a user.

Once the deformation of the cracking layer is complete and at least one discontinuity is created on the cover of the ball, regardless of the structure or method disclosed herein used, the recycling process can begin. The discontinuity or cracking may allow the cover and core to be more easily separated from one another than by a typical crushing or grinding that is typically done to separate the core and cover and to remove any adhesive. In this way, the use of the presently disclosed structures and methods may accelerate the recycling process, and in addition may reduce the cost to recycle the ball materials. The use of the disclosed system and method may also assist with the removal of adhesive as an additional feature. Further, the use of some of the methods and structures may assist users in determining when to replace a ball due to deterioration. Accordingly, the present disclosure provides various methods and structures that provide various benefits in manufacturing and use.

The present embodiments relate generally to the use of an intermediate layer that may create a crack or discontinuity on a cover of a ball or layer of a layered article. The present embodiments may also be used if it is desired to completely remove at least a portion of the cover or a layer from a ball or other layered article. Such a configuration and method are described in greater detail in U.S. Patent Application Publication No. 2013/0225325, entitled BALL INCORPORATING ELEMENT TO REMOVE COVER, filed concurrently herewith, the content of which is incorporated herein by reference. The present embodiments may also be used if it is desired to merely to cause separation between a core and a cover or two layers of a layered article. Such a configuration and method are described in greater detail in U.S. Patent Application Publication No. 2013/0225322, entitled BALL INCORPORATING COVER SEPARATION ELEMENT, filed concurrently herewith, the content of which is incorporated herein by reference.

Although the embodiments discussed herein are limited to golf balls, the invention is not intended to be so limited. The technology described herein may be applicable to any layered article, particularly a projectile, ball, recreational device, or component thereof.

While various embodiments of the invention have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

What is claimed is:

1. A golf ball, comprising:

a core;

a cover disposed radially outwardly of the core; and at least one cracking element positioned within the ball capable of creating at least one discontinuity on the cover when the cracking element is stimulated by an external stimulus, wherein the cracking element includes a first material embedded within the ball and a second material embedded within the ball, wherein the first material is separated from the second material by a physical barrier until the ball is impacted with sufficient force to remove the physical barrier, and wherein the first material and the second material chemically react to create a gas when the physical barrier is removed.

2. The golf ball according to claim 1, wherein the cracking element comprises at least a portion of an intermediate layer.

3. The golf ball according to claim 1 wherein the cracking element is positioned within the cover.

4. A method of preparing a golf hall for recycling, comprising:

providing a golf ball having at least one core layer, at least one cover layer forming an outer surface of the golf ball, and a cracking layer between the core layer and the cover layer forming the outer surface of the golf ball; and deforming the cracking layer to minimize the effort required to remove the at least one cover layer from the at least one core layer, wherein the deforming step comprises chemically reacting a first material and a second material in the cracking layer.

* * * * *